US008223116B2

(12) United States Patent
Lee et al.

(10) Patent No.: US 8,223,116 B2
(45) Date of Patent: Jul. 17, 2012

(54) LIQUID CRYSTAL DISPLAY DEVICE AND DRIVING METHOD THEREOF

(75) Inventors: Tae Wook Lee, Paju-si (KR); Ji Kyoung Kim, Seoul (KR)

(73) Assignee: LG Display Co. Ltd., Seoul (KR)

( * ) Notice: Subject to any disclaimer, the term of this patent is extended or adjusted under 35 U.S.C. 154(b) by 788 days.

(21) Appl. No.: 12/327,169

(22) Filed: Dec. 3, 2008

(65) Prior Publication Data

US 2010/0060555 A1 Mar. 11, 2010

(30) Foreign Application Priority Data

Sep. 10, 2008 (KR) ..... 10-2008-0089278

(51) Int. Cl.
*G09G 3/36* (2006.01)
*G09G 3/32* (2006.01)

(52) U.S. Cl. ..... 345/102; 345/82

(58) Field of Classification Search ..... None
See application file for complete search history.

(56) References Cited

U.S. PATENT DOCUMENTS

2006/0109234 A1* 5/2006 Hong et al. ..... 345/102
2006/0164379 A1* 7/2006 Oh et al. ..... 345/102
2007/0152926 A1* 7/2007 Kwon ..... 345/82
2008/0180383 A1* 7/2008 Lin et al. ..... 345/102
2008/0297464 A1* 12/2008 Ito ..... 345/102

FOREIGN PATENT DOCUMENTS

JP 2002-099250 4/2002
JP 2005-338857 12/2005
JP 2007-212782 8/2007

OTHER PUBLICATIONS

Office Action issued in corresponding Japanese Patent Application No. 2008-316324, mailed Oct. 26, 2011.

* cited by examiner

*Primary Examiner* — Christopher R Lamb
(74) *Attorney, Agent, or Firm* — Brinks Hofer Gilson & Lione

(57) ABSTRACT

An LCD device adapted to apply an optimized luminance in correspondence with a brightness of each divisional region of image is disclosed. The LCD device uses dimming curves, which are provided differently from each other, for divisional regions which are divided from one frame and have different pixel numbers. Therefore, the LCD device can a luminance optimized to a brightness of each divisional region of image, thereby preventing a luminance mismatching phenomenon and a luminance nullity phenomenon.

14 Claims, 8 Drawing Sheets

| | | | | | |
|---|---|---|---|---|---|
| BLK [1,1] | BLK [1,2] | BLK [1,3] | BLK [1,4] | ··· | BLK [1,m] |
| BLK [2,1] | | | | | |
| BLK [3,1] | | | | | |
| ⋮ | | ⋮ | | ··· | |
| BLK [n,1] | | | | | BLK [n,m] |

| | | | | | | | | |
|---|---|---|---|---|---|---|---|---|
| A | A | B | A | B | A | B | A | A |
| A | A | B | A | B | A | B | A | A |
| A | A | B | A | B | A | B | A | A |
| A | A | B | A | B | A | B | A | A |
| A | A | B | A | B | A | B | A | A |
| A | A | B | A | B | A | B | A | A |
| A | A | B | A | B | A | B | A | A |
| A | A | B | A | B | A | B | A | A |
| A | A | B | A | B | A | B | A | A |

A : 107X120 = 12840
B : 106X120 = 12720

| | | | | | | | | |
|---|---|---|---|---|---|---|---|---|
| A | A | B | A | B | A | B | A | A |
| A | A | B | A | B | A | B | A | A |
| C | C | D | C | D | C | D | C | C |
| A | A | B | A | B | A | B | A | A |
| C | C | D | C | D | C | D | C | C |
| A | A | B | A | B | A | B | A | A |
| A | A | B | A | B | A | B | A | A |

A : 107X154
B : 106X154
C : 107X155
D : 106X155

LIQUID CRYSTAL DISPLAY DEVICE AND DRIVING METHOD THEREOF

RELATED APPLICATIONS

This application claims priority under 35 U.S.C. 119 to Korean Patent Application No. 10-2008-0089278, filed on Sep. 10, 2008, which is hereby incorporated by reference in its entirety.

BACKGROUND

1. Field of the Disclosure

This disclosure relates to a liquid crystal display device adapted to control a luminance of backlight unit according to a brightness of each divisional region of image, and a driving method thereof.

2. Description of the Related Art

As the information society grows, display devices capable of displaying information have been widely developed. These display devices include liquid crystal display (LCD) devices, organic electro-luminescence display devices, plasma display devices, and field emission display devices. Among the above display devices, the LCD devices have advantages that they are light and small and can be driven with low power drive and provide a full color moving image. Accordingly, the LCD devices have been widely used for mobile phones, navigation systems, portable computers, televisions and so on.

FIG. 1 is a block diagram schematically showing an LCD device of the related art. Referring to FIG. 1, the LCD device includes a timing controller 1, a gate driver 2, a data driver 3, a liquid crystal panel 4, a backlight controller 5, a backlight driver 6, and a backlight unit 7.

The timing controller 1 receives control signals, such as a vertical synchronous signal, a horizontal synchronous signal, a data enable signal, and others, together with a data signal, from the exterior. From the vertical and horizontal synchronous signals and the data enable signal, the timing controller 1 derives first control signals for driving the gate driver 2 and second control signals for driving the data driver 3. Moreover, the timing controller 1 generates a backlight control signal for driving the backlight unit 7.

The first control signals enable the gate driver 2 to apply scan signals to the liquid crystal panel 4. The second control signals also enable the data driver 3 to convert the data signal into an analog data voltage and to apply the converted analog data voltage to the liquid crystal panel 4.

The backlight controller 5 generates a backlight drive signal in accordance with the backlight control signal and applies the backlight drive signal to the backlight driver 6. The backlight driver 6 supplies the backlight unit 7 with a drive voltage derived from the backlight drive signal. The backlight unit 7 irradiates a light in correspondence with to the drive voltage to the liquid crystal panel 4.

The liquid crystal panel 4 displays an image on the basis of the refractive index of a liquid crystal which is interposed between two substrates. More specifically, the liquid crystal panel 4 varies the refractive index of the liquid crystal along with the analog data voltage and allows a transmissive amount of light, which is transmitted from the backlight unit 7 through it, to be adjusted in accordance with the refractive index of the liquid crystal, thereby displaying the image.

In this manner, the related art LCD device allows the light of uniform luminance to be irradiated to the entire surface of the liquid crystal panel, regardless of whether the image has regions must be more brightly or darkly displayed. Accordingly, the image on the liquid crystal panel can not be more brightly or darkly displayed in certain regions. As a result, the related art LCD device decreases the contrast ratio and furthermore deteriorates the visual discernment of the image.

BRIEF SUMMARY

According to one general aspect of a present embodiment, an LCD device includes: a liquid crystal panel with a plurality of pixels arranged in a matrix; a backlight controller generating at least two PWM signals for lights different from each other in luminance, the lights applied to at least two divisional regions divided from an image of one frame which is displayed on the liquid crystal panel; a backlight unit including at least two blocks defined opposite the divisional regions; and a backlight driver supplying the blocks of the backlight unit with at least two drive signals corresponding to the PWM signals.

A driving method of LCD device according to another aspect of the present embodiment is applied to an LCD device which includes a liquid crystal panel with a plurality of pixels arranged in a matrix and a backlight unit with at least two blocks. The driving method of LCD device includes: dividing an image of one frame, which will be displayed on the liquid crystal panel, into at least two regions opposite to the blocks; generating a dimming address in accordance with a mean brightness value of each of the divided regions; generating a dimming signal, opposite to the generated dimming address, for each of the divided regions on the basis of dimming curves which are provided for each of the divided regions; and generating PWM signals each corresponding to the dimming signals for the divided regions and applying the PWM signals to the blocks of the backlight unit.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims. Nothing in this section should be taken as a limitation on those claims. Further aspects and advantages are discussed below in conjunction with the embodiments. It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the embodiments and are incorporated in and constitute a part of this application, illustrate embodiment(s) of the invention and together with the description serve to explain the disclosure. In the drawings.

DETAILED DESCRIPTION OF THE DRAWINGS AND THE PRESENTLY PREFERRED EMBODIMENTS

Figure 1:
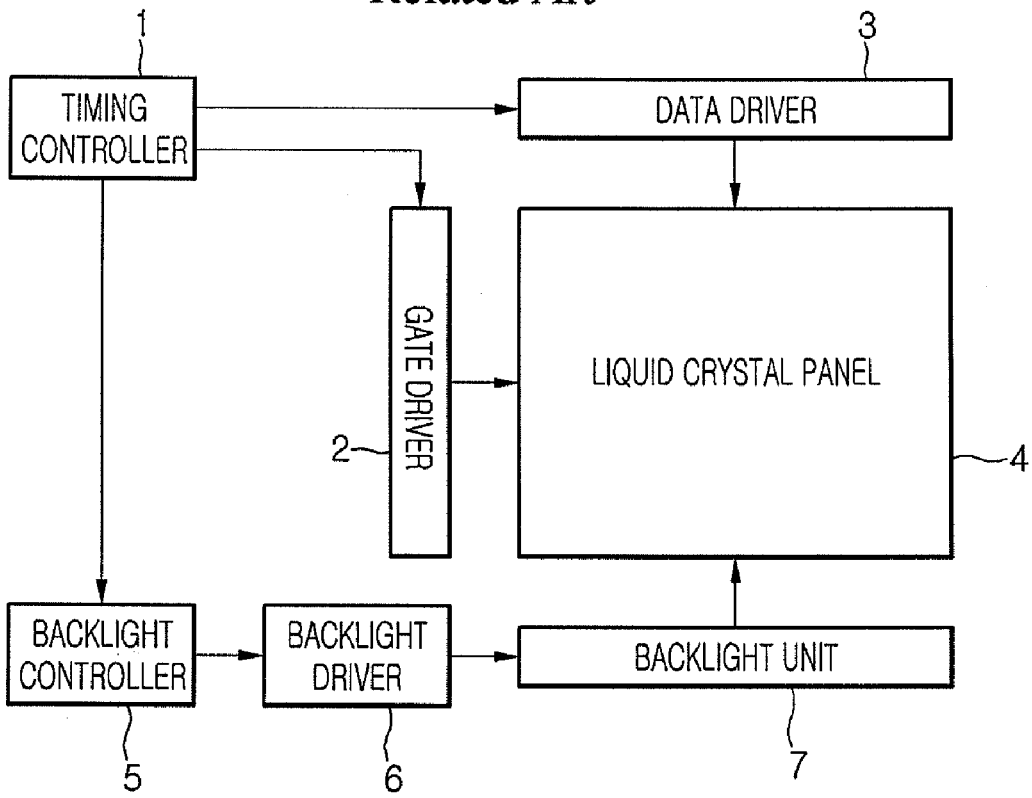
FIG.1 Related Art
FIG. 1 is a schematic block diagram showing an LCD device of related art.

Reference will now be made in detail to the embodiments of the present disclosure, examples of which are illustrated in the accompanying drawings. These embodiments introduced hereinafter are provided as examples in order to convey their spirits to the ordinary skilled person in the art. Therefore, these embodiments might be embodied in a different shape, so are not limited to these embodiments described here. Also, the size and thickness of the device might be expressed to be exaggerated for the sake of convenience in the drawings. Wherever possible, the same reference numbers will be used throughout this disclosure including the drawings to refer to the same or like parts.

Figure 2:
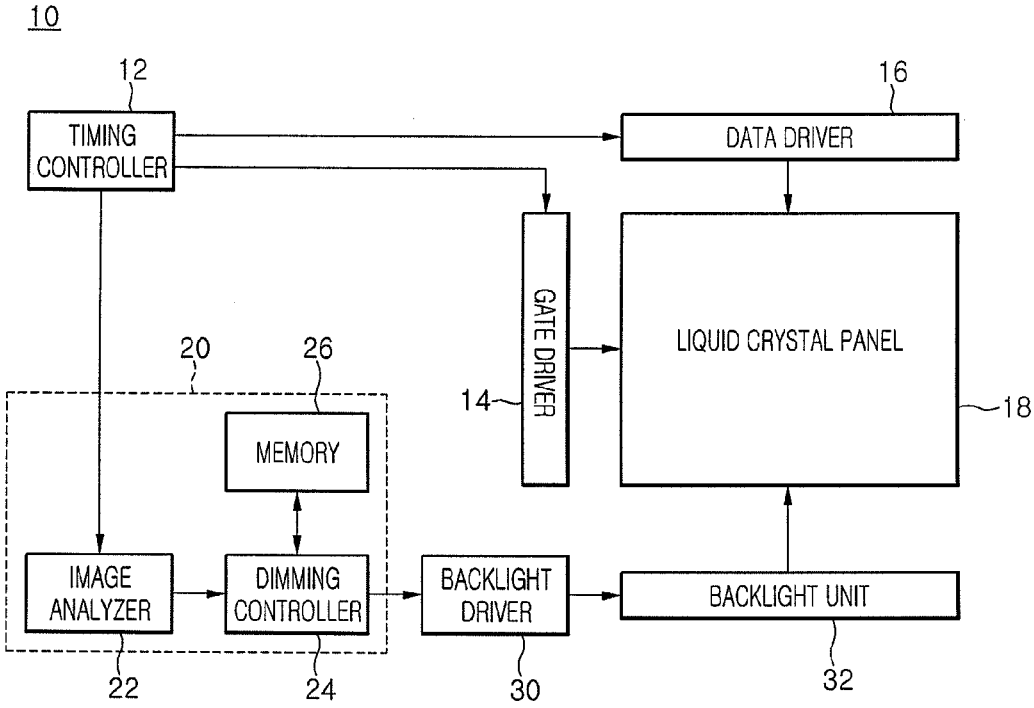
FIG. 2 is a schematic block diagram showing an LCD device according to a first embodiment of the present disclosure.
Figure 3:
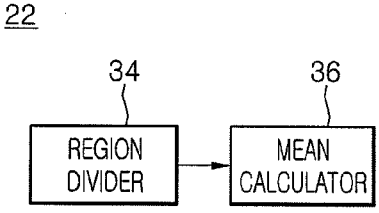
FIG. 3 is a block diagram showing in detail the image analyzer in FIG. 2.

FIG. 2 is a schematic block diagram showing an LCD device according to a first embodiment of the present disclosure. FIG. 3 is a block diagram showing in detail an image analyzer in FIG. 2. Referring to FIG. 2, the LCD device 10 includes a timing controller 12, a gate driver 14, a data driver 16, a liquid crystal panel 18, a backlight controller 20, a backlight driver 30, and a backlight unit 32.

The liquid crystal panel 18 includes upper and lower substrates and an interposed liquid crystal between the substrates.

The lower substrate includes a plurality of gate lines and a plurality of data lines which are arranged to cross each other. The crossed gate and data lines define the lower substrate into unit pixels which are arranged in a matrix shape. Each of the unit pixels includes a thin film transistor and a pixel electrode. The thin film transistor is disposed in an intersection of the gate and data lines. The pixel electrode is connected to the thin film transistor.

The upper substrate includes red, green and blue color filters opposite to the respective pixels and a black matrix disposed between the color filters. Also, the upper substrate can further include a common electrode disposed on the color filters and the black matrix. Such an upper substrate having the common electrode is applied to a liquid crystal panel of TN (Twisted nematic) mode. Alternatively, the common electrode can be disposed on the lower substrate in case the liquid crystal panel 18 is in an in-plane switching mode.

Consequently, the liquid crystal panel 18 has a plurality of color pixels arranged in the matrix shape. These color pixels on the liquid crystal panel 18 may be responsive to respective red, green and blue data voltages so that the image of one frame may be displayed.

The timing controller 12 receives an image of frame unit from an external video source, for example, a video card of computer or information terminal. The timing controller 12 also receives a vertical synchronous signal, a horizontal synchronous signal, a data enable signal, and other signals, which are used for controlling an image display, from the video card. From the vertical and horizontal synchronous signals and data enable signal, the timing controller 12 derives first control signals for driving the gate driver 14 and second control signals for driving the data driver 16. The first control signals may include a gate start pulse GSP, a gate shift clock GSC, and a gate output enable signal GOE. The second control signals also may include a source start pulse SSP, a source shift clock SSC, and a source output enable signal SOE.

The gate driver 14 responds to the first control signals and sequentially applies scan signals to the gate lines on the liquid crystal panel 18. As such, the thin film transistors of the pixels on the respective gate lines are sequentially turned on line by line.

The data driver 16 also responds to the second control signals and converts the pixel data for the image by the line into analog data voltages. The converted analog data voltages are applied to the pixels on the gate line to which the scan signal is applied. The analog data voltage applied to each pixel together with a common voltage on the common electrode may vary the refractive index of the liquid crystal.

The backlight controller 20 receives the image data of frame unit, the vertical and horizontal synchronous signals, and the data enable signal from the timing controller 12. The backlight controller 20 includes an image analyzer 22, a dimming controller 24, and a memory 26.

The image analyzer 22 may include an image divider 34 and a mean calculator 36, as shown in FIG. 3. The image divider 34 uses the vertical and horizontal synchronous signals, data clock and data enable signal and divides the image data of one frame into a plurality of regional data. The plurality of divided regional data may be opposed to the plural blocks of the backlight unit 32, respectively. In other words, the divided regional data number can depend on the number of the blocks which is included in the backlight unit 32.

Figures 4, 5:
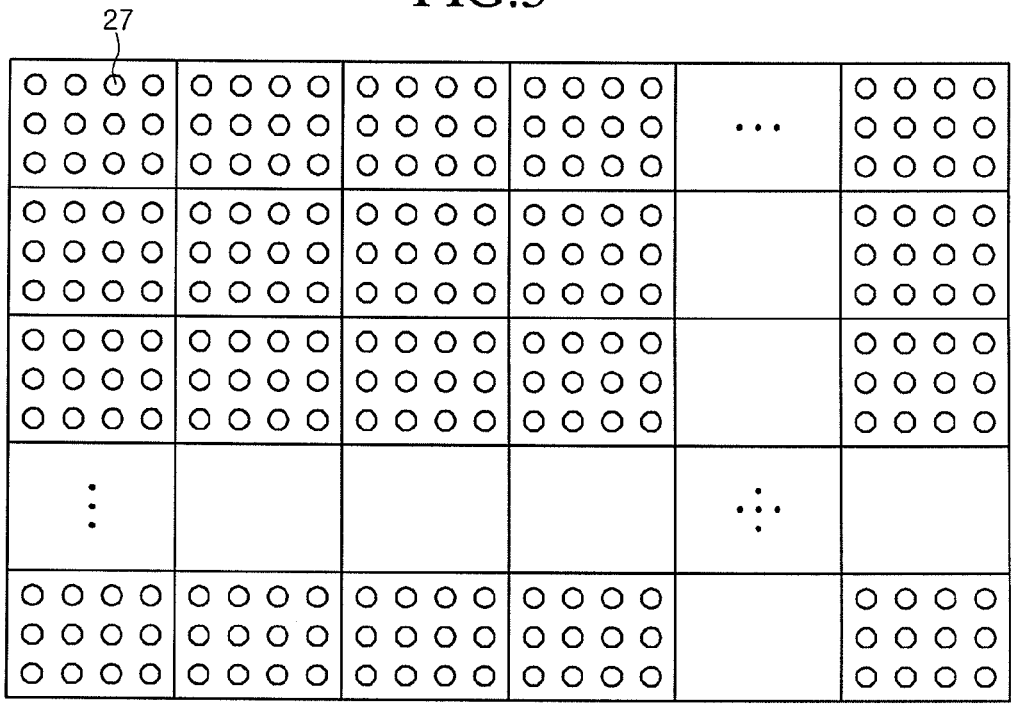
FIG. 4 is a view showing an arrangement configuration of blocks which are included in the backlight unit of FIG. 2.
FIG. 5 is a view explaining an embodiment of the blocks shown in FIG. 4.

If the backlight unit 32 includes m×n blocks as shown in FIG. 4, the image data of one frame may also be divided into m×n regional data. Herein, "m" is a block number or a regional data number in a horizontal direction and "n" is another block number or another regional data number in a vertical direction.

For example, it is assumed that one frame includes 1920×1080 pixels and is divided into 20 regions in the horizontal direction and 9 regions in the vertical direction and the 1920 pixel data in the horizontal direction are supposed to be applied to the liquid crystal panel 18 through two ports. Then, each divided regional data includes 120 (i.e., 1080/9) pixel data in the vertical direction and 96 (i.e., 1920/20) pixel data in the horizontal direction. Consequently, each of the 180 divided regional data may include "120×96=11520" pixel data. The LCD device according to the first embodiment of the present disclosure will be explained with a limitation that all of the divided regional data include pixel data of same number.

Figures 6, 7:
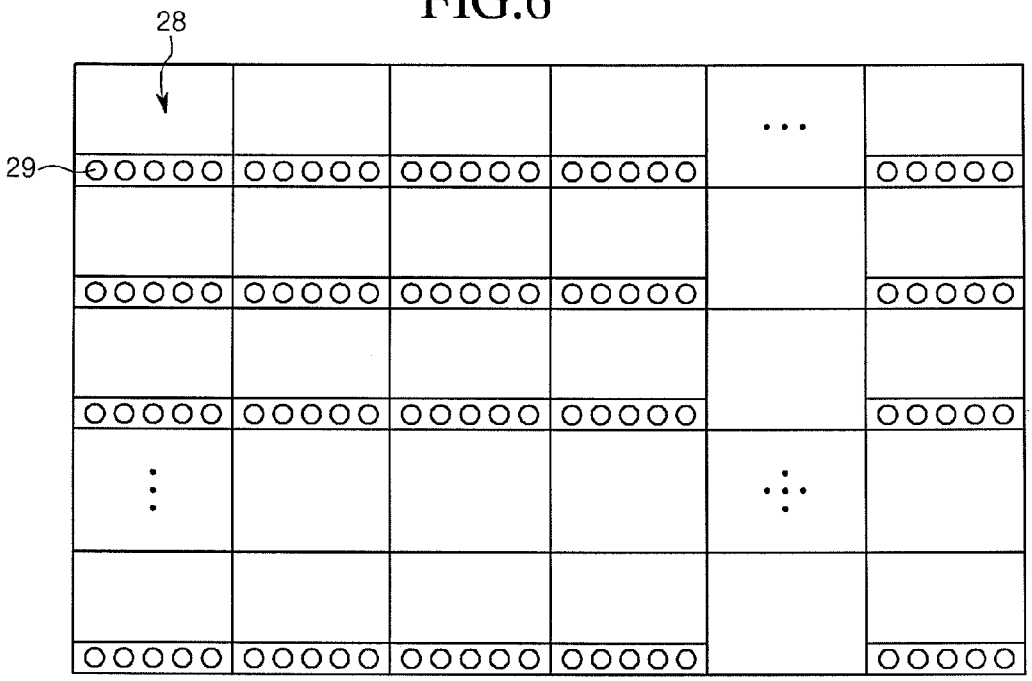
FIG. 6 is a view explaining another embodiment of the blocks shown in FIG. 4.
FIG. 7 is a view showing an arrangement configuration of divisional regions into which an image is divided by the image analyzer of FIG. 2.

The plural blocks included in the backlight unit 32 can be configured as shown in FIG. 5 or FIG. 6.

The backlight unit 32, shown in FIG. 5, includes a plurality of blocks which each have a plurality of light emission diodes 27. The light emission diodes 27 involved in the same block respond to a same drive voltage so that they emit lights equal to one another in luminance. The light emission diodes 27 in the different blocks are driven by the different drive voltages, thereby emitting lights different from one another in luminance. Accordingly, each block can emit light in an optimized luminance. The light emission diodes 27 in each block can be loaded on a package (not shown). In this case, the backlight unit may include the light emission diode packages which are arranged in respective blocks.

On the other hand, a plurality of blocks involved in the backlight unit 32 each include: a light guide plate 28 guiding the lights toward its front direction (i.e., a direction perpendicular to its upper surface); and light emission diodes 29 loaded on a package (not shown) which is disposed in parallel with a side of the light guide plate 28, as shown in FIG. 6. The light emission diodes 29 may be of a side emission type. In other words, the light emission diodes 29 may emit lights in side directions. Therefore, the lights emitted from the light emission diodes 29 on the package may enter into the light guide plate 28 and may progress toward the front direction (i.e., a direction perpendicular to the upper surface of the light guide plate 28) by means of the light guide plate 28.

Returning to FIG. 3, the image divider 34 divides one frame image data into a plurality of regional data which are respectively opposed to the plural blocks included in the backlight unit 32. To this end, the image divider 34 may use the vertical and horizontal synchronous signals and data enable signal. As described above, each divided regional data may include 11520 pixel data.

The mean calculator 36 calculates a mean brightness value for the plural pixel data which are included in each divided regional data. A brightness value of each pixel data may be of a digital signal.

Due to this, the mean brightness value for each regional data may include a relatively large number of bits. Accordingly, for convenience of calculation, the mean calculator 36 eliminates fixed lower bits from the mean brightness value. Exemplarily, the LCD devices according to the embodiments of the present disclosure will be described to limit the fixed lower bits to 13 lower bits.

If the number of pixel data included in one divided region is 96×120, the mean brightness value may maximally be in a gray level of "255 gray level×96×122=2937600" which corresponds to a 22 bit binary data of "01 0111 0010 0111 0100 0000". When the lower 13 bits are eliminated from the binary data of 22 bits, the mean brightness value may become a gray level of "010111001=185". In other words, the mean brightness value of each divided regional data may be in a range of "0" to "185" steps (i.e., gray scale levels). Such a mean brightness value having the range of "0" to "185" steps can be provided as a dimming address.

In this way, the mean calculator 36 calculates the mean brightness value of each regional data and eliminates the fixed lower bits from the mean pixel brightness value. The mean calculator 36 outputs the bit-eliminated mean brightness values as the dimming addresses.

The memory 26 stores a dimming curve in which the dimming addresses and the dimming signals are arranged as input values and output values, in a table shape. Actually, 186 dimming signals can be stored opposite the dimming addresses of 0~185 steps in the table. These dimming signals may be brightness signals each having a gray scale level optimized to the mean brightness value of each regional data. Such dimming signals may be digital signals.

The dimming controller 24 reads out the dimming signals, which are designated by the dimming addresses from the image analyzer 22, in the memory 26. Also, the dimming controller 24 generates pulse width modulation (PWM) signals which have duty ratios corresponding to the respective dimming signals. The PWM signals generated in the dimming controller 24 are applied to the backlight driver 30.

The backlight driver 30 generates drive signals corresponding to the respective PWM signals from the dimming controller 24 and applies the drive signals to the respective blocks. The drive signals may be voltage or current signals each varying along the duty ratio of the PWM signal.

The light emission diodes 27 or 29 included in each of the blocks of the backlight unit 32 emit a light of luminance corresponding to the drive signal which is applied from the backlight driver 30.

As thus described, the dimming addresses for the plural divided regional data are generated in the mean calculator 36, the PWM signals for the dimming signals corresponding to the respective dimming addresses are output from the dimming controller 24, and the drive signals corresponding to the PWM signals are provided in the backlight driver 30. In the blocks of the backlight unit 32, the lights each having a luminance corresponding to each drive signal are emitted.

In other words, the LCD device according to the first embodiment of the present disclosure enables the blocks of the backlight unit 32 to emit lights different from each other in luminance, thereby displaying images of optimized brightness on the regions of the liquid crystal panel 18. Accordingly, the LCD device can more brightly display the regions of an image which will be brightly displayed, while can more darkly display the regions of an image which will be darkly displayed. As a result, the LCD device may increase the contrast ratio, and furthermore may improve the visual discernment of the image.

The LCD device according to the first embodiment of the present disclosure has been described on the assumption that all the divided regions within one frame include the same number of pixels. However, the liquid crystal panels of certain sizes force one frame not to be divided into the regions which all include the same number of pixels. Particularly, an arbitrary divisional region number makes some regions very possible to be different from the rest of the regions in pixel number.

For example, there are assumptions that one frame of 1920×1080 pixels is divided into 9 regions in a vertical direction and 18 regions in a horizontal direction, i.e., 9×18=182 regions, and that the 1920 pixels in the horizontal direction (i.e., the pixels for one line) are applied to a liquid crystal panel through two ports. In this case, each of the divisional regions includes 1080/9=120 pixels in the vertical direction and 1920/18=106.666 pixels in the horizontal direction. Due to this, 18 divisional regions in the horizontal direction can not include the same pixels in number. Consequently, among the 18 divisional regions in the horizontal direction, 6 divisional regions may each have 106 pixels in the horizontal direction, while 12 divisional regions may each have 107 pixels in the horizontal direction.

The 182 regions divided as the above can be depicted as FIG. 7. In FIG. 7, one frame is divided into first regions A each having 107×120 pixels and second regions B each having 106×120 pixels. In other words, each of the first regions A may include 12840 pixels, and each of the second regions B may also include 12820 pixels.

As such, a dimming address of each first region having a range of 0 to 399 steps may be generated when a mean brightness value of the regional data for each first region A are calculated and the 13 lower bits are eliminated from the calculated mean brightness value. Similarly, another dimming address of each second region having a range of 0 to 395 steps may be generated when another mean brightness value of second regional data for each second region B are calculated and the 13 lower bits are eliminated from the calculated mean brightness value.

Figure 8A:
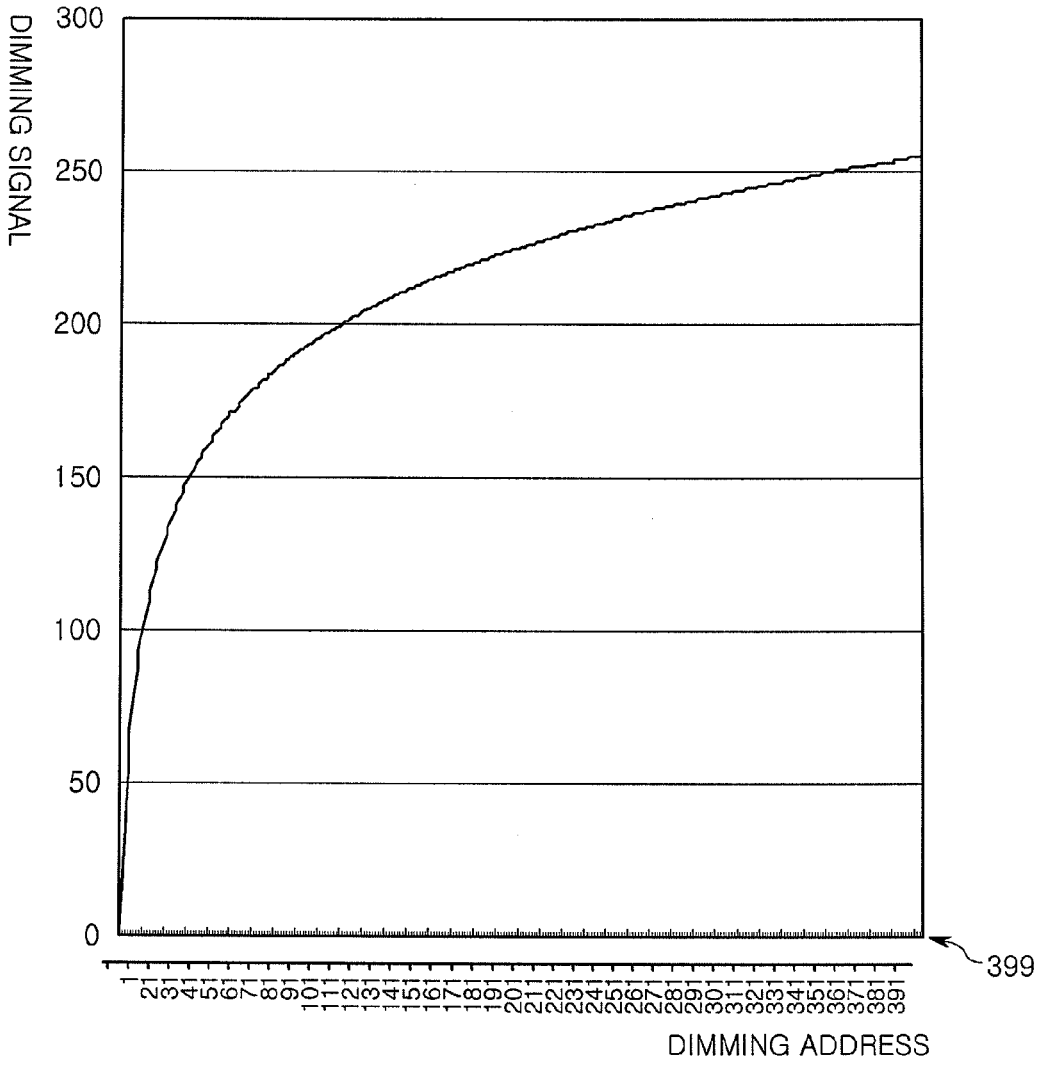
FIG. 8A is a view showing a first dimming curve for the first divisional regions in FIG. 7.
Figure 8B:
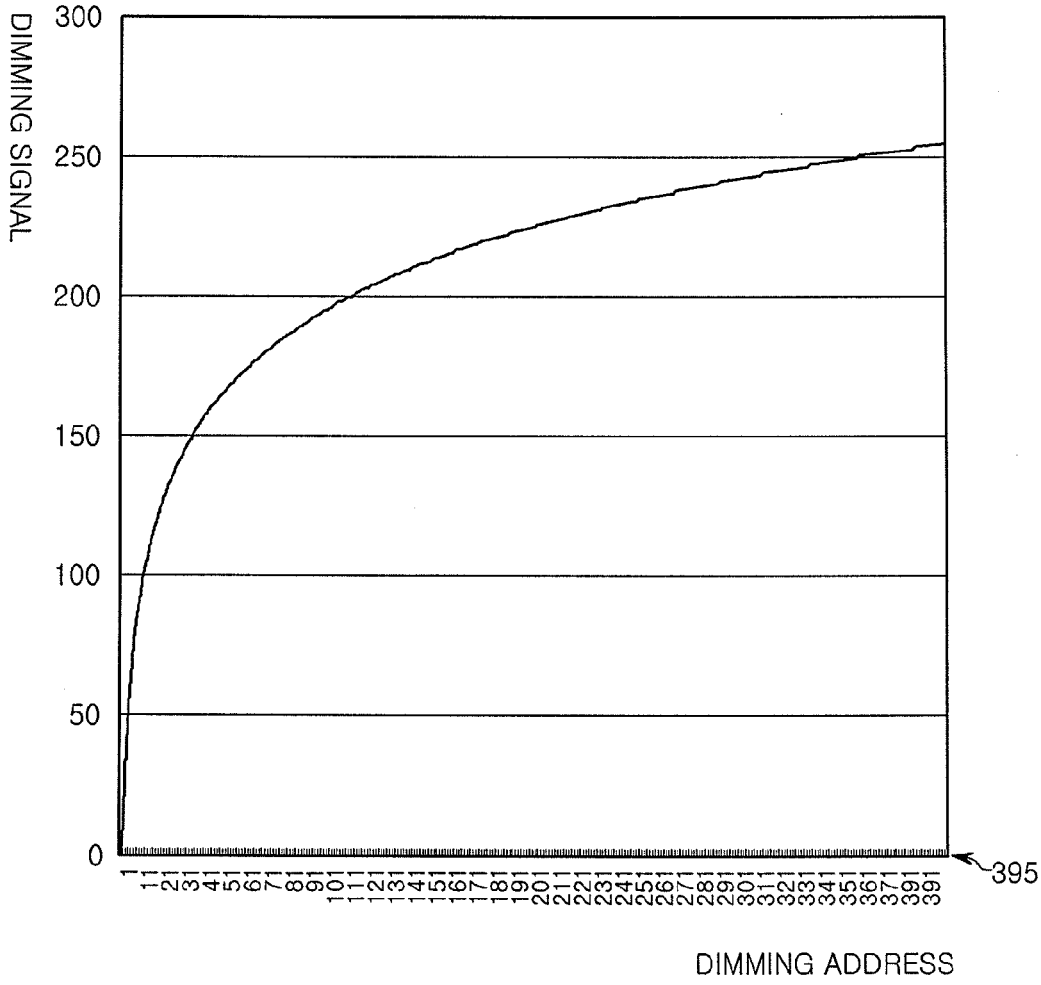
FIG. 8B is a view showing a second dimming curve for the second divisional regions in FIG. 7.

Moreover, a first dimming curve for dimming the first regions A and a second dimming curve for dimming the second divisional regions B can be explained by FIGS. 8A and 8B. Referring to FIG. 8A, a dimming signal for the first divisional regions A may be in a gray scale level range of 0-255 which varies along the dimming address set of 0~399 steps in the manner of the first dimming curve. Another dimming signal for the second regions B may also be in the gray scale level range of 0 to 255 which varies along the dimming address set of 0~395 steps in the manner of the second dimming curve. As seen from FIGS. 8A and 8B, the second dimming curve for the second regions B is not defined opposite the dimming addresses of 396~399 steps. Therefore, the gray scale level opposite to each step of the first dimming curve may be set differently from that opposite to each step of the second dimming curve.

If the first dimming curve is commonly applied to the irst and second regions A and B of different sizes, the dimming signal for the first regions A may be optimized, while the dimming signal for the second regions B may not be optimized, because the first dimming curve is different from the second dimming curve in the gray scale level opposite to the dimming address. Due to this, a luminance mismatching phenomenon may be caused in the second region B.

On the contrary, when the second dimming curve is commonly applied to the first and second regions A and B, the dimming signal for the second region B is optimized. The dimming signal for the first region A can not be generated in a dimming address interval of 396 to 399 which is not opposed to any gray scale levels. A luminance nullity can be caused in the first regions A, because the blocks of the backlight unit 32 opposite to the first regions A are not driven.

To address these problems, an LCD device according to a second embodiment of the present disclosure is proposed below.

Figures 9, 10:
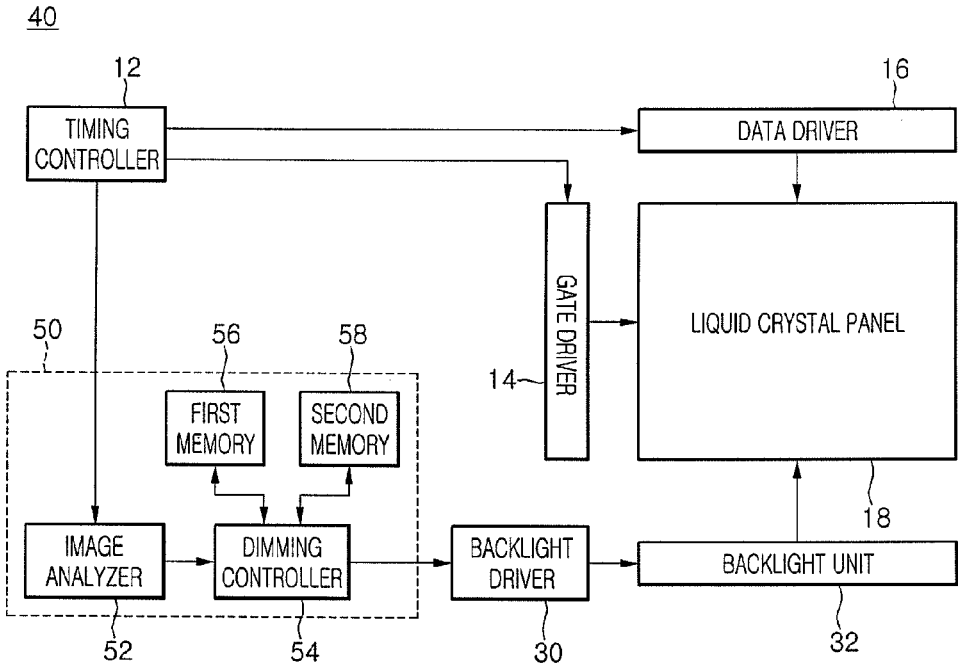
FIG. 9 is a schematic block diagram showing an LCD device according to a second embodiment of the present disclosure.
FIG. 10 is a view showing an arrangement configuration of divisional regions, into which an image is divided by the image analyzer of FIG. 9, having different numbers of pixels from each other in horizontal and vertical directions.

FIG. 9 is a schematic block diagram showing an LCD device 40 according to a second embodiment of the present disclosure. In the LCD device 40 of the second embodiment, a timing controller 12, a gate driver 14, a data driver 16, a liquid crystal panel 18, a backlight driver 30, and backlight unit 32 have the same functions and reference numerals as those of the first embodiment. Therefore, these elements included in the LCD device 40 of the second embodiment are referred to the same numerals as those in the LCD device 10 of the first embodiment, and will be omitted in the detailed description.

The LCD device 40 of the second embodiment will perform the dimming of first and second regions which are defined on one frame and have different numbers of pixels from each other. Actually, the LCD device 40 of the second embodiment divides one frame into 12 first regions A each having 107 pixels and 6 second regions B each having 106 pixels, in a horizontal direction, but is not limited to this. In other words, the LCD device 40 of the second embodiment can divide one frame into first and second regions each having the different numbers of pixels in a vertical direction. Moreover, the LCD device of the second embodiment divides one frame into the first and second regions A and B for the convenience of explanation, it can allow one frame further to include third regions each having a different number of pixels from the first and second regions A and B due to the number of regions.

The LCD device 40 of the second embodiment includes a backlight controller 50 connected between the timing controller 12 and backlight driver 30. The backlight controller 50 includes an image analyzer 52, a dimming controller 54, and first and second memory 56 and 58.

The image analyzer 52 includes a region divider and a mean calculator which are not shown in the drawing. These elements have the same functions as the region divider 34 and mean calculator 36 included in the LCD device 10 of the first embodiment. Therefore, detailed explanations of the region divider and mean calculator will be omitted.

The image analyzer 52 divides the image data of one frame into a plurality of first regional data for the first regions A and a plurality of second regional data for the second regions B. Each first regional data A may include 107×120 pixel data, and each second regional data B may include 106×120 pixel data.

The image analyzer 52 calculates a mean brightness value for each first regional data A, and generates a first dimming address by eliminating fixed lower constant bits, for example, 13 lower bits, from the calculated mean brightness value. Also, the image analyzer 52 calculates another mean brightness value for each second regional data B, and generates a second dimming address by eliminating the fixed lower bits, for example, 13 lower bits, from the other mean brightness value. The first dimming addresses and second dimming addresses generated in the image analyzer 52 are applied to the dimming controller 54.

The first memory 56 stores a first dimming curve, having first dimming signals for the first regions A, in a table shape. The first dimming curve is configured in such a manner that it uses the first dimming addresses of "0" to "399" steps as input values and the first dimming signals having a gray scale level range of "0" to "255" as output values opposite to the first dimming addresses.

Similarly, the second memory 58 stores a second dimming curve, having second dimming signals for the second regions A, in a table shape. The second dimming curve is configured in such a manner that it uses the second dimming addresses of "0" to "395" steps as input values and the second dimming signals having a gray scale level range of "0" to "255" as output values opposite to the second dimming addresses.

The dimming controller 54 reads out the first dimming signals for the first regions A from the storage positions of the first memory 56 which are designated by the first dimming addresses received from the image analyzer 52. The dimming controller 54 generates first PWM signals corresponding to the respective first dimming signals. Also, the dimming controller 54 retrieves the second dimming signals for the second regions B from the storage positions of the second memory 58 which are designated by the second dimming addresses received from the image analyzer 52. The dimming controller 54 generates second PWM signals corresponding to the respective second dimming signals.

The backlight driver 30 applies first drive signals, each corresponding to the first PWM signals from the dimming controller 54, to the first blocks of the backlight unit 32. Also, the backlight driver 30 supplies the second blocks of the backlight unit 32 with second drive signals each corresponding to the second PWM signals from the dimming controller 54. The first blocks may be opposite the plurality of the first regional data A divided by the image analyzer 52, respectively. Similarly, the second blocks may be opposite the plurality of the second regional data B divided by the image analyzer 52, respectively.

The first blocks of the backlight unit 32 emit first lights of first luminance each corresponding to the first drive signals. The second blocks of the backlight unit 32 also emit second lights of second luminance each corresponding to the second drive signals. The first luminance may be different from the second luminance in level. Also, the first lights from the first blocks of the backlight unit 32 may be different from one another in luminance, and the second lights from the second blocks of the backlight unit 32 may be different from one another in luminance.

In this manner, the LCD device of the second embodiment stores the first and second dimming curves adapted to the first and second regions A and B of different pixel numbers. Also, the LCD device performs the dimming of the first regions A on the basis of the first dimming curve and the dimming of the second regions B on the basis of the second dimming curve. Accordingly, the LCD device can prevent the luminance mismatching phenomenon and the luminance nullity phenomenon.

Although the above LCD device according to the second embodiment of the present disclosure is applied to the case that the regions is divided to have the same pixel number in the vertical direction and different pixel numbers in the horizontal direction, it can also be applied to another case where the regions is divided to have the same pixel number in the horizontal direction and different pixel numbers in the vertical direction.

Furthermore, the regions can be divided to have different pixel numbers in all the vertical and horizontal directions. For example, one frame can be divided into regions of four sizes, i.e., first to fourth regions A to D, each being different from one another in pixel number, as shown in FIG. 10. The first regions A each can include 107×154 pixels, the second regions B 106×154 pixels, the third regions C 107×155 pixels, and the fourth regions D 106×155 pixels.

Figure 11:
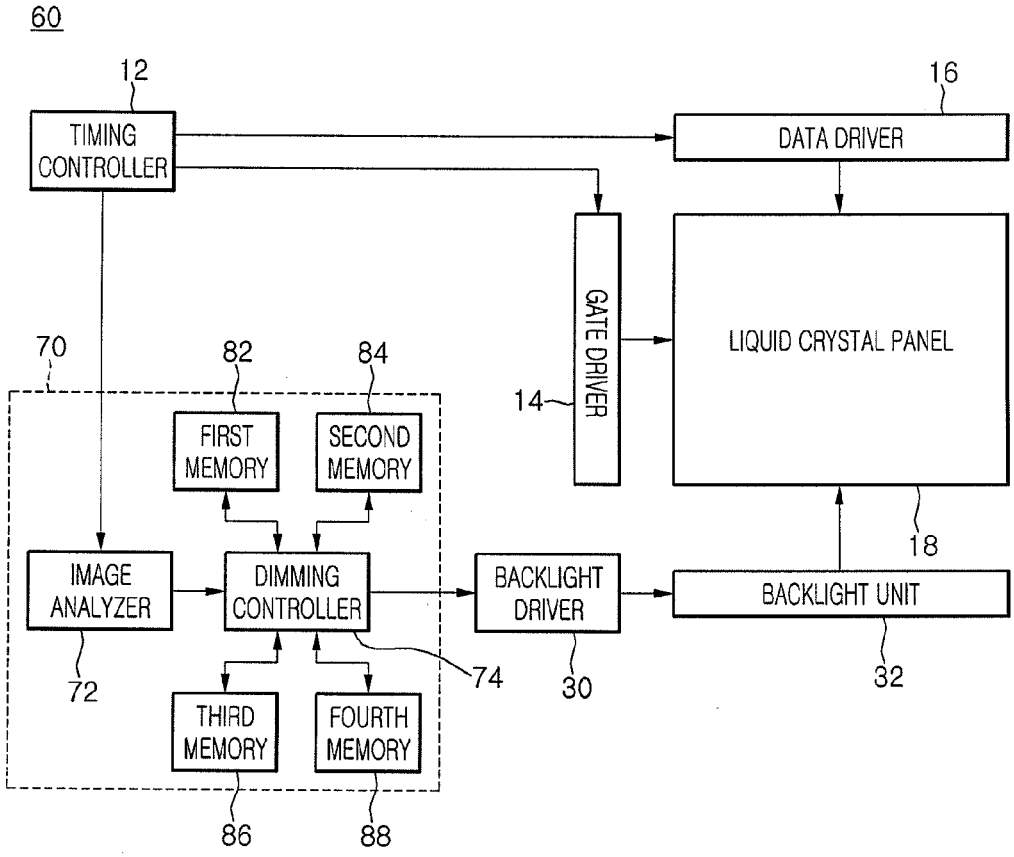
FIG. 11 is a schematic block diagram showing an LCD device according to a third embodiment of the present disclosure.

FIG. 11 is a schematic block diagram showing an LCD device 60 according to a third embodiment of the present disclosure. A timing controller 12, a gate driver 14, a data driver 16, a liquid crystal panel 18, a backlight driver 30, and backlight unit 32 included in the LCD device 60 of the third embodiment, have the same functions as those of the LCD device 10 of the first embodiment. Therefore, these elements included in the LCD device 60 of the third embodiment are referred to the same numerals as those in the LCD device 10 of the first embodiment, and will be omitted in the detailed description.

The LCD device 60 of the third embodiment will perform the dimming of first to fourth regions A to D which are divided on one frame and have pixel numbers different from one another. Even if the LCD device of the third embodiment divides one frame into the first to fourth regions A to D for the convenience of explanation, it can divide one frame to include fifth and sixth regions having pixel numbers different from the first to fourth regions A to D, due to the number of regions.

The LCD device 60 includes a backlight controller 70 connected between the timing controller 12 and the backlight driver 30. The backlight controller 70 includes an image analyzer 72, a dimming controller 74, and first to fourth memories 82, 84, 86, and 88.

The image analyzer 72 includes a region divider and a mean calculator which are not shown in the drawing. These elements have the same functions as the region divider 34 and mean calculator 36 in the LCD device 10 of the first embodiment. Therefore, the detailed explanations of the region divider and mean calculator will be omitted.

The image analyzer 52 divides the pixel data for one frame into a plurality of regional data for first to fourth regions A to D. The first regional data for each first region A may include 107×154 pixel data, the second regional data for each second region B may include 106×154 pixel data, the third regional data for each third region C may include 107×154 pixel data, and the fourth regional data for each fourth region D may include 106×154 pixel data.

The image analyzer 72 calculates a mean brightness value for the first regional data for each first region A, and generates a first dimming address by eliminating fixed lower bits, for example, 13 lower bits, from the calculated mean brightness value. The image analyzer 72 also calculates a mean brightness value for the second regional data for each second region B, and generates a second dimming address by eliminating the fixed lower bits, for example, 13 lower bits, from the calculated mean brightness value. The image analyzer 72 further calculates a mean brightness value for the third regional data for each third region C, and generates a third dimming address by eliminating the fixed lower bits, for example, 13 lower bits, from the calculated mean brightness value. Moreover, the image analyzer 72 calculates a mean brightness value for the fourth regional data for each fourth region D, and generates a fourth dimming address by eliminating the fixed lower bits, for example, 13 lower bits, from the calculated mean brightness value.

The first memory 82 stores a first dimming curve, which has first dimming signals for the first regions A, in a table shape. The second memory 84 stores a second dimming curve, which has second dimming signals for the second regions B, in a table shape. The third memory 86 stores a third dimming curve, which has third dimming signals for the third regions C, in a table shape. The fourth memory 88 stores a fourth dimming curve, which has fourth dimming signals for the fourth regions D, in a table shape.

The dimming addresses for the first to fourth dimming curves may be different from one another in step number. Actually, the first dimming address for the input value of the first dimming curve may have 300 steps, the second dimming address for the input value of the second dimming curve may have 250 steps, the third dimming address for the input value of the third dimming curve may have 330 steps, and the fourth dimming address for the input value of the fourth dimming curve may have 270 steps.

On the other hand, the dimming signals for the first to fourth dimming curves can have the same gray scale level range of 0 through 255.

The first dimming curve can be configured in such a manner that it uses the first dimming addresses of "0" to "399" steps as input values and the first dimming signals of gray scale level range of 0~255 as output values opposite to the first dimming addresses. The second dimming curve can also be configured in such a manner that it uses the second dimming addresses of "0" to "250" steps as input values and the second dimming signals of gray scale level range of 0~255 as output values opposite to the second dimming addresses. Moreover, the third dimming curve can be configured in such a manner that it uses the third dimming addresses of "0" to "330" steps as input values and the third dimming signals of gray scale level range of 0~255 as output values opposite to the third dimming addresses. Furthermore, the fourth dimming curve can be configured in such a manner that it uses the fourth dimming addresses of "0" to "399" steps as input values and the fourth dimming signals of gray scale level range of 0~255 as output values opposite to the fourth dimming addresses.

The dimming controller 74 reads out the first dimming signals for the first regions A from the storage positions of the first memory 82 opposite to the first dimming addresses which are applied from the image analyzer 72. The dimming controller 74 generates first PWM signals corresponding to the respective first dimming signals. The dimming controller 54 also reads out the second dimming signals for the second regions B from the storage positions of the second memory 84 opposite to the second dimming addresses which are applied from the image analyzer 72. The dimming controller 74 generates second PWM signals corresponding to the respective second dimming signals. Moreover, the dimming controller 74 reads out the third dimming signals for the third regions C from the storage positions of the third memory 86 opposite to the third dimming addresses which are applied from the image analyzer 72. The dimming controller 74 generates third PWM signals corresponding to the respective third dimming signals. Furthermore, the dimming controller 74 reads out the fourth dimming signals for the fourth regions D from the storage positions of the second memory 88 opposite to the fourth dimming addresses which are applied from the image analyzer 52. The dimming controller 74 generates fourth PWM signals corresponding to the respective fourth dimming signals.

The backlight driver 30 applies first drive signals, each corresponding to the first PWM signals from the dimming controller 74, to the first blocks of the backlight unit 32. The backlight driver 30 also supplies the second blocks of the backlight unit 32 with second drive signals each corresponding to the second PWM signals from the dimming controller 74. Moreover, the backlight driver 30 applies third drive signals, each corresponding to the third PWM signals from the dimming controller 74, to the third blocks of the backlight unit 32. Furthermore, the backlight driver 30 supplies the fourth blocks of the backlight unit 32 with fourth drive signals each corresponding to the fourth PWM signals from the dimming controller 74. The first blocks may be opposed to the first regions A divided by the image analyzer 52, the second blocks may be opposed to the second divisional regions B, the third blocks may be opposed to the third regions, and the fourth blocks may be opposed to the fourth regions. This block arranging configuration of the backlight unit 32 will easily be understood through FIGS. 4 to 6.

The first blocks of the backlight unit 32 emit first lights of first brightness each corresponding to the first drive signals. The second blocks of the backlight unit 32 also emit second lights of second brightness each corresponding to the second drive signals. Moreover, the third blocks of the backlight unit 32 emit third lights of third brightness each corresponding to the third drive signals. Furthermore, the fourth blocks of the backlight unit 32 emit fourth lights of fourth brightness each corresponding to the fourth drive signals. The first to fourth lights may be different from one another in brightness. In addition, the first lights from the first blocks of the backlight unit 32 may be different from one another in brightness, the second lights from the second blocks of the backlight unit 32 may be different from one another in brightness, the third lights from the third blocks of the backlight unit 32 may be different from one another in brightness, and the fourth lights from the fourth blocks of the backlight unit 32 may be different from one another in brightness.

In this way, the LCD device of the third embodiment stores the first to fourth dimming curves adapted to the first to fourth regions A to D of the different pixel numbers. Also, the LCD device performs the dimming of the first regions A on the basis of the first dimming curve, the dimming of the second regions B on the basis of the second dimming curve, the dimming of the third regions C on the basis of the third dimming curve, and the dimming of the fourth regions D on the basis of the fourth dimming curve. Accordingly, the LCD device can prevent the luminance mismatching phenomenon and the luminance nullity phenomenon.

As described above, the LCD devices according to the embodiments of the present disclosure supply the regions divided on the liquid crystal panel with lights which are different from one another in brightness, thereby optimizing the luminance in correspondence with each divisional region. Also, the LCD devices according to the embodiments of the present disclosure store the dimming curves adapted to the regions of the different pixel numbers, and perform the dimming for each of the regions on the basis of the corresponding dimming curve. Therefore, the LCD devices can prevent the luminance mismatching phenomenon or the luminance nullity phenomenon.

It will be apparent to those skilled in the art that various modifications and variations can be made in the present disclosure. Thus, it is intended that the present disclosure cover the modifications and variations of this embodiment provided they come within the scope of the appended claims and their equivalents.

The invention claimed is:

1. A liquid crystal display device comprising:

a liquid crystal panel with a plurality of pixels arranged in a matrix;

a backlight controller that generates at least two PWM signals for lights different from each other in luminance, the lights applied to at least two divisional regions divided from an image of one frame which is displayed on the liquid crystal panel;

a backlight unit including at least two blocks defined opposite the divisional regions; and a backlight driver that supplies the blocks of the backlight unit with at least two drive signals corresponding to the PWM signals, wherein the backlight controller includes:

an image analyzer that divides the image of one frame into the divisional regions by the number of the blocks defined on the backlight unit, and generates dimming addresses according to mean brightness values of the divisional regions;

a dimming controller that retrieves dimming signals each opposed to the dimming addresses and generates the PWM signals each corresponding to the retrieved dimming signals; and at least one memory each that stores at least one dimming curve, configured with the dimming addresses and the dimming signals opposite to the dimming addresses, for the at least two divisional regions, wherein the dimming addresses are different from each other in number in the at least two divisional regions.

2. The liquid crystal display device claimed as claim 1, wherein the number of the dimming addresses increases as the divisional region includes more pixels.

3. The liquid crystal display device claimed as claim 1, wherein the dimming signal is a brightness signal being in a range of 0 to 255 gray scale levels.

4. The liquid crystal display device claimed as claim 1, wherein the dimming curves are provided as the number of the divisional regions.

5. The liquid crystal display device claimed as claim 1, wherein the divisional regions include at least two regions which have a different number of pixels from each other in the horizontal direction of the liquid crystal panel.

6. The liquid crystal display device claimed as claim 1, wherein the divisional regions include at least two regions which have a different number of pixels from each other in the vertical direction of the liquid crystal panel.

7. The liquid crystal display device claimed as claim 1, wherein the divisional regions include at least four regions which have different numbers of pixels from one another in the vertical and horizontal directions of the liquid crystal panel.

8. The liquid crystal display device claimed as claim 1, wherein each of the blocks includes a plurality of light emission diodes.

9. The liquid crystal display device claimed as claim 1, wherein each of the blocks includes a light guide plate and a plurality of light emission diodes arranged in a side of the light guide plate.

10. The liquid crystal display device claimed as claim 1, wherein the number of divisional regions depends on the number of blocks of the backlight unit.

11. A method of driving a liquid crystal display device which includes a liquid crystal panel with a plurality of pixels arranged in a matrix and a backlight unit with at least two blocks, comprising:

dividing an image of one frame, which will be displayed on the liquid crystal panel, into at least two regions opposite to the blocks;

generating dimming addresses in accordance with mean brightness values of the divided regions;

generating a dimming signal, opposite to each of the dimming addresses, for each of the divided regions on the basis of dimming curves which are provided for each of the divided regions; and generating PWM signals each corresponding to the dimming signals for the divided regions and applying the PWM signals to the blocks of the backlight unit, wherein the dimming addresses are different from each other in number in the divided regions.

12. The method as claim 11, wherein the divided regions are opposed to the blocks defined on the backlight unit.

13. The method claimed as claim 11, wherein each of the dimming curves is configured to use the dimming addresses and signals as input and output values.

14. The method claimed as claim 11, wherein the blocks of the backlight unit opposite to the divisional regions emit lights which are different from one another in brightness.

* * * * *